US006334341B1

(12) United States Patent
Hellhake et al.

(10) Patent No.: US 6,334,341 B1
(45) Date of Patent: Jan. 1, 2002

(54) CYLINDER WASHING MACHINE

(75) Inventors: Wolfgang Hellhake, Lippstadt; Siegfried Augustin, Bielefeld, both of (DE)

(73) Assignee: Miele & Cie. GmbH & Co., Guetersloh (DE)

( * ) Notice: Subject to any disclaimer, the term of this patent is extended or adjusted under 35 U.S.C. 154(b) by 0 days.

(21) Appl. No.: 09/297,550

(22) PCT Filed: Oct. 31, 1997

(86) PCT No.: PCT/EP97/06033

§ 371 Date: Jun. 14, 1999

§ 102(e) Date: Jun. 14, 1999

(87) PCT Pub. No.: WO98/20195

PCT Pub. Date: May 14, 1998

(30) Foreign Application Priority Data

Nov. 2, 1996 (DE) ..... 196 45 273

(51) Int. Cl.[7] ..... D06F 37/06

(52) U.S. Cl. ..... 68/124; 68/24; 68/58

(58) Field of Search ..... 68/24, 58, 140, 68/142, 144; 366/228, 234, 233, 232; 134/159

(56) References Cited

U.S. PATENT DOCUMENTS

| | | | | | |
|---|---|---|---|---|---|
| 523,343 | A | * | 7/1894 | Haberacker | |
| 622,552 | A | * | 4/1899 | Skinner | 68/142 |
| 980,558 | A | * | 1/1911 | Pfeiffer | 68/142 |
| 1,254,187 | A | * | 1/1918 | Aldrich | 68/142 |
| 1,396,456 | A | * | 11/1921 | Mueller | |
| 1,444,687 | A | * | 2/1923 | Jepson | |
| 1,943,709 | A | * | 1/1934 | Wilkins | |
| 2,591,143 | A | | 4/1952 | Eilersgaard | 68/140 |
| 3,582,523 | A | * | 6/1971 | Linnhoff | |
| 5,275,026 | A | * | 1/1994 | Chilcoat | 68/142 |

FOREIGN PATENT DOCUMENTS

| | | | | |
|---|---|---|---|---|
| BE | 531047 | * | 8/1954 | |
| DE | 921743 | * | 11/1954 | |
| DE | 185335 | * | 4/1956 | |
| DE | 1410985 | | 11/1968 | |
| DE | 2557215 | | 6/1977 | B21C/37/15 |
| DE | 2826506 | | 1/1979 | D06F/37/04 |
| DE | 4437986 | | 4/1996 | B21D/31/06 |

* cited by examiner

*Primary Examiner*—Frankie L. Stinson
(74) *Attorney, Agent, or Firm*—Karl Hormann

(57) ABSTRACT

The invention relates to a washing machine or a washer-dryer with a drum (3) mounted in a suds basin (2) for horizontal or inclined rotation and having a cylindrical wall (3.1) and to cover plates (3.2; 3.3), the cylindrical wall (3.1) or one of the cover plates (3.2; 3.3) being provided with a removal opening and the cylindrical wall (3.1) being made in part or completely from sheet metal provided with a texturized bulges facing the interior of the drum. In order to provide for an optimally gentle laundry treatment at the same time as good visual appearance and complete exhaustion of residual water the holes (16) in the cylindrical wall (3.1) are disposed on the outwardly facing marginal contours (17.1) of the bulges>alternatively, the holes (16) may be disposed in sections (3.5, 3.6) of the cylindrical wall (3.1) formed without bulge texturization.

7 Claims, 5 Drawing Sheets

CYLINDER WASHING MACHINE

BACKGROUND OF THE INVENTION

1. Field of the Invention

The invention relates to a washing machine or washer-dryer provided with a drum mounted for horizontal or inclined rotation within a suds basin and provided with a cylindrical wall and two end plates, the cylindrical wall or one of the end plates being provided with a removal opening and the cylindrical wall being made completely or in part of sheet metal texturized with bulges facing the interior of the drum.

2. The Prior Art

Drums for automatic washers or washer-dryers usually consist of sheet metal structures. Owing to high spinning speeds of up to 1,600 rpm the drums are subject to stringent requirements as regards their strength, dimensional stability and rigidity. From German patent 4,437,986 A1 and laid-open specification 2,557,215 it is known to texturized the sheet metal from which the drum is to be made with bulges in order to increase its strength.

Furthermore, it is conventional in washing machines to provide perforations in the cylindrical wall as well as, if necessary, in the end plates to ensure an exchange of suds between the laundry and the suds basin. In present day washing machines these perforations have a diameter in the order of 3.5 mm. To this end, during manufacture of the drum holes with a diameter of about 2.5 mm are initially punched into a sheet metal coil and are thereafter deepened to a funnel shape and flared to 3.5 mm, by an embossing process known as drift punching. When shaping and welding a cut coil section into a cylindrical wall the recesses of the holes are directed towards the outside. This is done to ensure that no burrs at the edge of any hole protrude into the interior of the drum, thus to prevent contact between the laundry and such burrs. Drift punching and the resultant structure of the inner surface of the drum results on the one hand in a reduced planar surface relative to the overall cylindrical surface and, on the other hand, in diffuse reflection of light falling into the drum. This not only creates an impression of high quality and gloss, that is to say of high-grade material, but it also suppresses the visibility of scratches and impurities.

A washing machine is known from U.S. Pat. No. 2,591,143 the drum of which is provided with a bulging texturization structured as corrugations extending over the entire length of the cylindrical wall of the drum. In this arrangement, the perforations of the drum are disposed within the outwardly facing recesses. His leads to residual water remaining in the planar sections between the holes and to impeding drainage. Moreover, such a drum structure leads to excessive abrasion and, hence, damage of the laundry.

In connection with the mentioned drums it has been found to be disadvantageous that the relatively large perforations are the cause of burls in fabrics, damaged laundry and undesirable passage of threads and foreign matter. For this reason, it has been proposed to reduce the diameter of the holes (German laid-open specification 1,410,985) and/or to restrict the perforations to certain areas of the cylindrical wall (German patent 2,826,506).

To obtain drift punched holes of a 2 mm diameter, the diameter of the punching tools must not exceed a maximum diameter of about 1.2 mm. The gauge of the sheet metal customarily used for washing machine drums would quickly lead to breaking of the tools. For that reason, it is not possible to manufacture washing machine drums with drift punched holes in an automated fabrication process.

Drums with hole diameters of about 2 mm which have not been drift punched thus have a relatively smooth surface which lacks the previously described optical property. This is also true of drums perforated in partial areas as the non-perforated sections of their cylindrical wall are completely smooth. Moreover, another drawback of such drums is that residual water will remain on the smooth surface and impedes drainage.

OBJECT OF THE INVENTION

It is, therefore, an object of the invention so to structure the drum of a washing machine that it provides a good visual appearance as well as complete drainage of residual water.

BRIEF SUMMARY OF THE INVENTION

In accordance with the invention the object is achieved by drum washing machines wherein at least the cylindrical surface of the drum is texturized with a plurality of bulges of polygonal configuration facing the interior of the drum and forming between them marginal contours extending towards the exterior of the drum and wherein holes are provided in the marginal contours at the corner points of the polygons;

Aside from solving the aforementioned problems, the advantages to be derived from the invention reside in increased stability of the drum. This allows reduction of the costs incurred by the use of heavy-gauge sheet metals or complex forming processes (e.g. expanding). Alternatively, the safety space between the drum and the suds basin which during spinning serves to prevent contact between drum and suds basin may be reduced while maintaining given sheet metal gauges. In this manner, the so-called dead space between the wall of the drum and the wall of the suds basin is reduced, i.e. the quantity of free suds is reduced (low water and energy consumption) and the volume of the drum may be enlarged. Structuring the bulging texturization as polygons facing the interior of the drum and placing the holes at the corner points of the marginal contours results in a pattern of the bulging texturization which can be manufactured relatively easily and, in addition, the holes are disposed at the lowest points which leads to a significant improvement in the drainage of the washing suds and of the rinsing water, as the case may be.

In another inventive embodiment of the drum washing machine according to the invention the holes are disposed in sections of the cylindrical wall which are free of any bulges. Such a drum facilitates perforating as the perforations need not conform to the configuration of the bulges. The holes may be arranged in marginal sections bordering on the end surfaces (cap, bottom) or in the center portion of the cylindrical wall.

It is also advantageous to provide the marginal contours with a flat portion extending in the circumferential direction of the cylindrical wall of the drum and to place the holes in this portion. In the manufacturing process described elsewhere (page 1, line 23 to page 2, line 1) structuring and stabilizing contours are embossed by expanding into the perforated cylindrical wall. Thereafter, it is provided with a texture of bulges by a process known from German patent 4,437,986 A1 or German laid-open specification 2,557,215. Such a process makes it impossible to punch perforations into the wall of the drum which has already been rounded and provided with the texture of bulges. It is relatively difficult vertically to align the perforations punched into the sheet metal coil and the bulges of the texture made by expanding the circular wall such that the holes are located precisely at the corner points of the bulging structure. Changing the sequence of the manufacturing steps to a process in which the structure is formed before it is perforated is also unsatisfactory in terms of manufacturing techniques since the bulging structures may become damaged by the perforation. Broadening the marginal contours enlarges the tolerance range in which the holes are to be placed so that perforating by an automated production process is simplified. This is particularly true where the width of the flat portion measures one and a half to two and a half times the diameter of a hole.

It is also advantageous to reduce number and diameter of the holes relative to those of conventional drum washing machines. This leads to a reduction in the passage of lint or threads and to a gentler treatment of the laundry.

DESCRIPTION OF THE SEVERAL DRAWINGS

Embodiments of the invention are depicted strictly schematically in the drawings and will hereafter be described in greater detail. In the drawings FIG. 1 depicts the general structure of a drum washing machine;

FIG. 2 is a view of a drum (3) in longitudinal section;

FIGS. 3, 3*a* schematically depict the form of the texture of the bulges and of the perforation in an area of the drum wall (3.1);

DETAILED DESCRIPTION OF THE PREFERRED EMBODIMENTS

Figure 1:
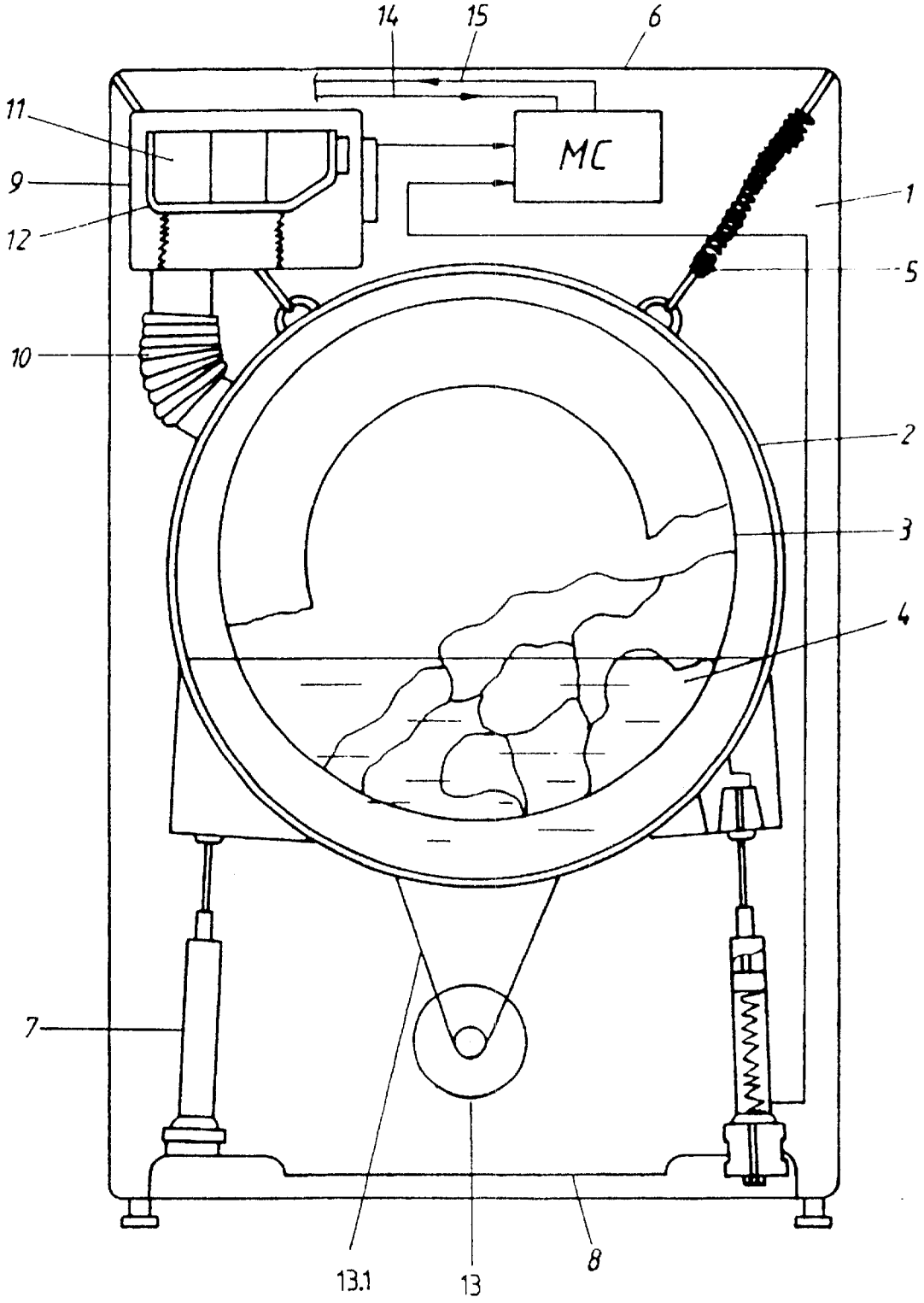
Figure 2:
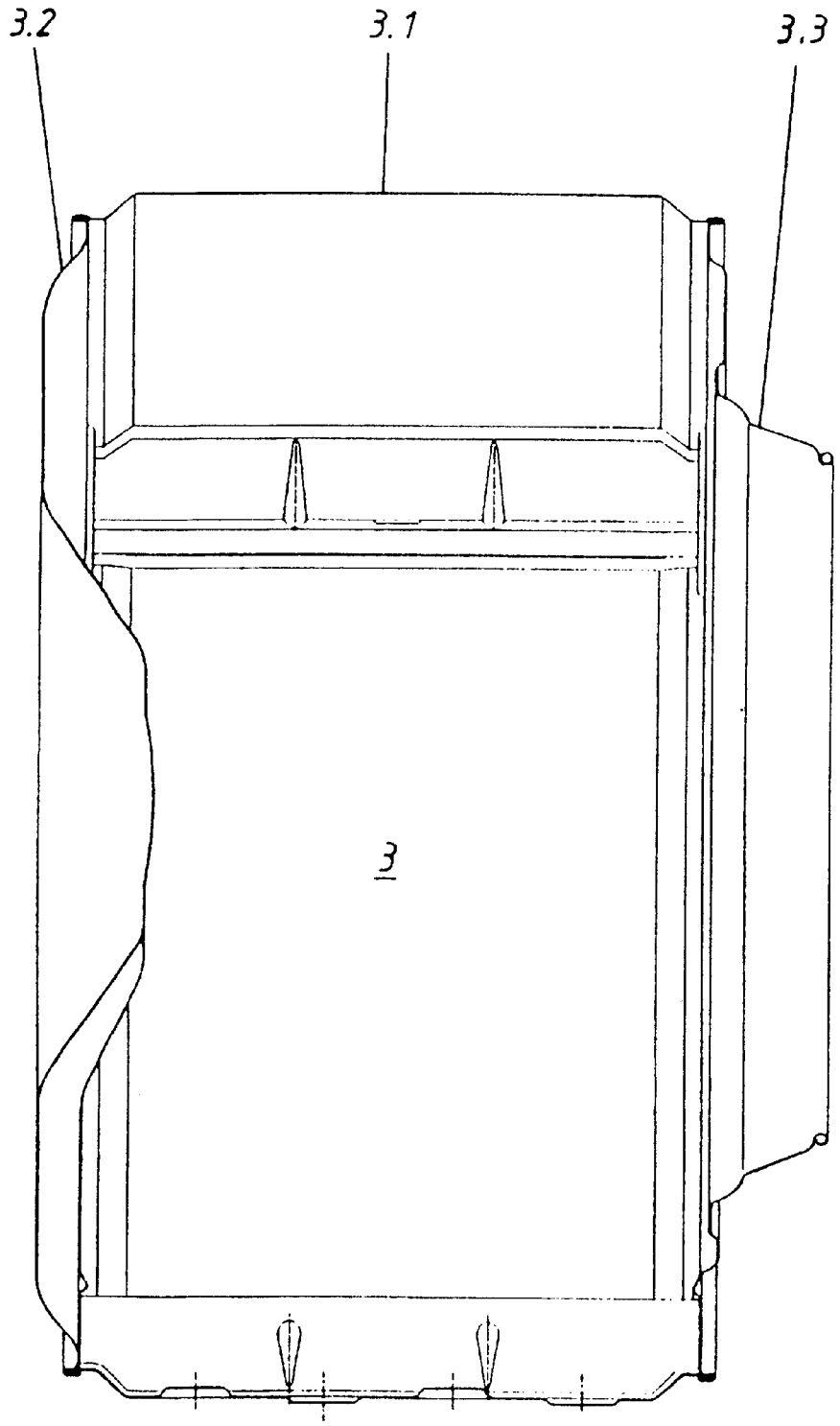

The drum washing machine (1) constructed in accordance with the invention is provided with a suds basin (2) within which there is rotatably mounted a drum (3) for receiving laundry (4). The drum (3) is driven by a motor (13) by way of a belt (13.1). The suds basin (2) is suspended for oscillating movements within the housing (6) by means of springs (5) and for damping these oscillations it is supported in its lower region by shock absorbers (7).

The detergents and fabric conditioners required for executing a washing program are fed to the suds basin (2) from a detergent flushing chamber (9) which is provided with a connecting hose (10). To this end, the desired substances may be put by a user into corresponding compartments (11) of a detergent drawer (12). At the start of a given program cycle the entire contents of the compartment are flushed into the suds basin (2) by a water conduit not shown in the drawings.

For the control of the different washing programs there is provided a microprocessor control (MC) which is connected to various sensors and operating elements by signal lines (14). It releases time and condition dependent commands to various actuators (motors, valves, indicators . . . ) by way of control lines (15).

The drum (3) is manufactured by an automated production process (not shown) described in greater detail elsewhere. To this end, a strip of sheet metal for the drum wall (3.1) is initially cut from a coil and is provided with the desired perforations (16) by punching. Thereafter, the strip of sheet metal is circularly bent and Rs two facing edges are welded together. The cylinder thus produced is provided with structuring and stabilizing contours by conventional expansion processes. Thereafter, the wall will be texturized with bulges by a process known from German laid-open specification 2,557,215. Following this, the bottom (3.2) and the cap (3.3) are attached.

Figure 3A:
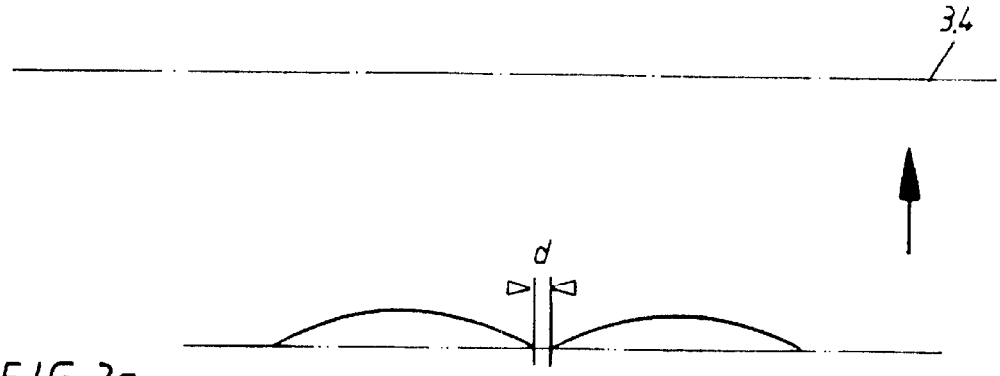
Figure 3:
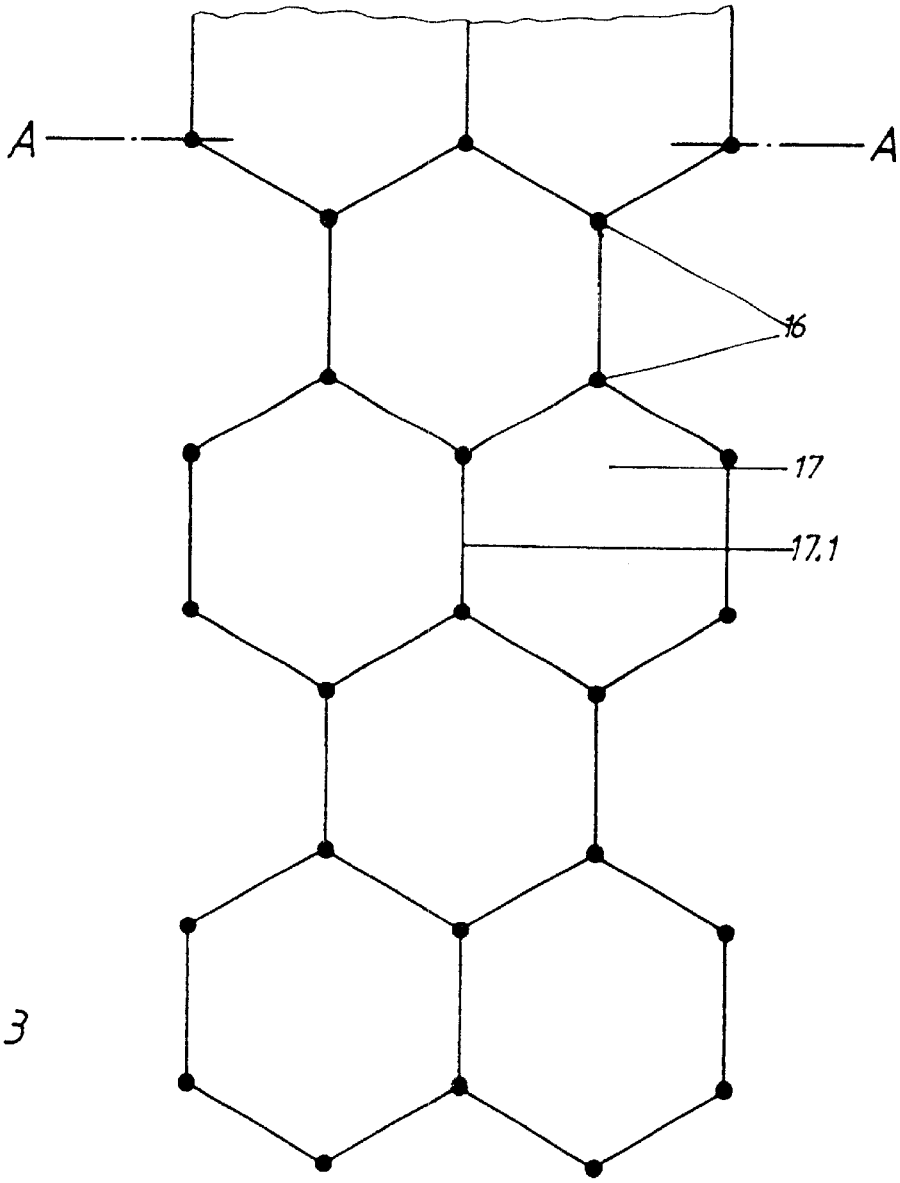

FIG. 3 depicts a section of the drum wall (3.1) with the basic structure of the bulge configuration and the arrangement of the perforations (16) in accordance with the invention.

The wall (3.1) is entirely or sectionally provided with inwardly bulging polygons, preferably hexagons (17). FIG. 3*a* shows a section of the wall (3.1) along line A—A which clearly shows the bulging of the hexagons (17) in the direction of the axis of the drum (3.4). Structures in which the end surfaces (cap (3.2) and bottom (3.3)) are provided with bulging polygons are possible as well. In the wall (3.1) of the drum there are provided holes (16) which are fewer in number than in drums (3) currently in use, and, preferably, of smaller diameter d (about 2 mm). These holes (16) are disposed in the outwardly directed marginal contours (17.1) of the bulges and, more particularly, at the corner points of the hexagons.

The disposition of the holes is governed by the requirement for quick and residue-free water drainage and an effective water extraction by spinning augmented by pumping or by pumping only, by an optimum preservation of the fabric, low sensitivity to foreign matter and an attractive visual appearance.

Figure 4:
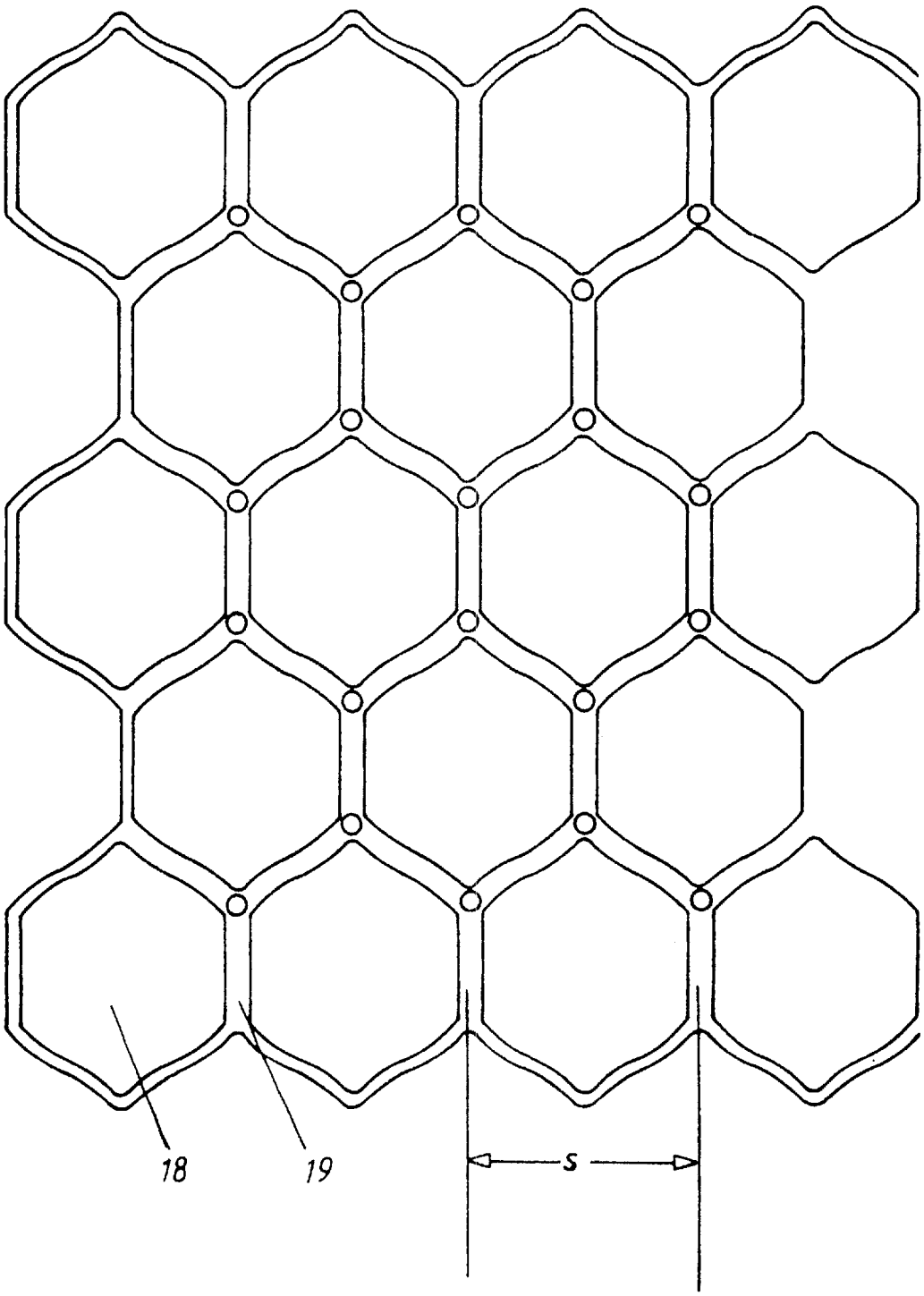
FIG. 4 is a further variant of the texture of the bulges and of the perforation in a section of the drum wall (3.1)

FIG. 4 depicts a section of a drum wall (3.1) with advantageous bulges structured as hexagons (18) with curved edges in which the marginal structures have a flat portion (19) facing in the circumferential direction of the wall (3.1) of the drum and measuring one and a half to two and a half times the diameter (d) of a hole, with the holes (16) being disposed in this portion (19). In the embodiment shown, the portions (19) have a width of 4 mm and the diameter (d) of the holes is 2 mm. The width s of the texturized pattern between opposite edges thereof is about one fifth of the width of the cylindrical wall. In the example shown it is 38.48 mm. The advantages of such an embodiment are described elsewhere.

Figure 5:
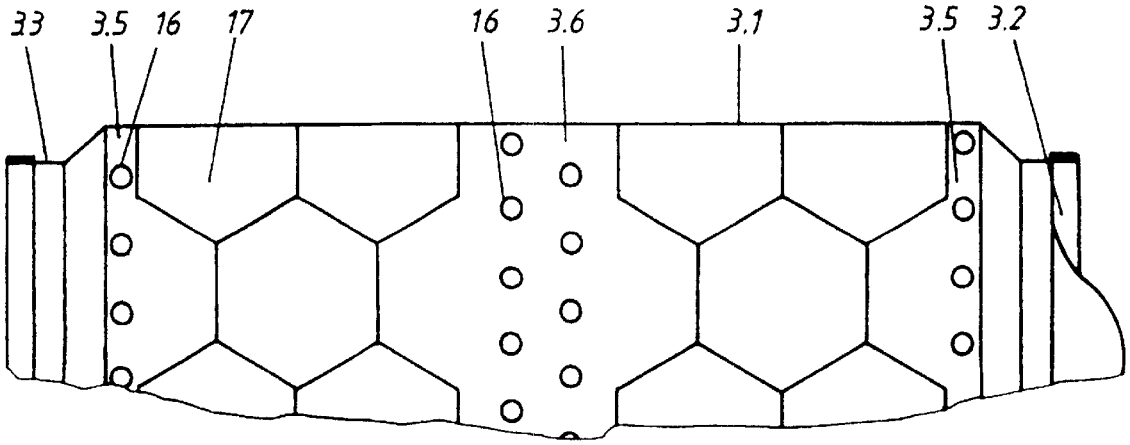
FIG. 5 is a section of a drum (3) with non-texturized sections.

Aside from drums (3) provided with perforations (16) in their bulged structural areas, a following variant shown in FIG. 5 is conceivable:

Rows of holes are disposed at front and rear margins (3.5) of the wall (3.1) of the drum which are free of bulges. In addition or alternatively, further limited unstructured zones (3.6) provided with holes (16) may be provided, for instance as shown in FIG. 5, in the center of the wall (3.1) of the drum. The bulge textured areas may then be completely unperforated so that the texturized structure serves only to strengthen the drum (3); however, the perforations (16) described above may also be provided in the preferred positions within the bulged structure, e.g. at the corner points (20) of the polygons (17).

Unless prevented by the formation during spinning of a pocket of standing water, the diameter of the drum (3) of every one of the embodiments described, given corresponding material thicknesses and an unchanged suds basin diameter, may be increased by up to 10 mm. In this manner, the smallest distance between the wall (3.1) of the drum and the suds basin need not exceed about 5 mm.

Drum walls (3.1) may be provided as cylinders texturized with bulges, and they may be subjected to a further forming operation (e.g. expanding) either before or after. It is also possible to process sheet blanks or coils prefabricated with texturized bulges (see German patent 4,437,986 A1) or to provide blanks or coils with bulging structures in a continuous operation, to perforate them before or afterwards and to subject them to further forming processes (e.g. roll forming, embossing, pressing, etc.), and to form them into cylinders.

The contemplations may be analogously applied to the bottom and to the cap.

What is claimed is:

1. A clothes washing machine, comprising:

a suds basin;

a drum made from sheet metal and rotatably suspended in the suds basin and comprising a first wall of substantially cylindrical configuration and first and second end walls attached to opposite ends of the first wall;

an access opening defined by at least one of the first and one of the end walls;

a plurality of bulges of polygonal periphery extending towards the interior of the drum and disposed adjacent each other in the first wall; and openings disposed at at least some of the corners in the periphery of at least some of the bulges.

2. The washing machine of claim 1, wherein opposite peripheral margins of each bulge are disposed in a circumferential direction of the first wall.

3. The washing machine of claim 2, wherein the periphery is of hexagonal configuration.

4. The washing machine of claim 3, wherein peripheral margins between adjacent bulges are separated by an axially flat contour measuring from about 1.5 to about 2.5 of the diameter of the openings.

5. The washing machine of claim 4, wherein the openings are disposed between peripheral margins.

6. The washing machine of claim 5, wherein in the diameter of the openings measures about 2 mm.

7. The washing machine of claim 6, wherein the smallest distance between the suds basin and the drum is about 5 mm.

* * * * *